US007931498B2

(12) United States Patent
Skeels et al.

(10) Patent No.: US 7,931,498 B2
(45) Date of Patent: Apr. 26, 2011

(54) COAXIAL CABLE CONNECTOR WITH A DEFORMABLE COMPRESSION CAP TO FORM A CONSTRICTION

(75) Inventors: Stephen J. Skeels, Manlius, NY (US); Noah Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 21 days.

(21) Appl. No.: 12/420,065

(22) Filed: Apr. 8, 2009

(65) Prior Publication Data

US 2010/0261380 A1 Oct. 14, 2010

(51) Int. Cl.
*H01R 9/05* (2006.01)

(52) U.S. Cl. ..... 439/578

(58) Field of Classification Search ..... 439/578–585
See application file for complete search history.

(56) References Cited

U.S. PATENT DOCUMENTS

| | | | | |
|---|---|---|---|---|
| 5,879,191 | A | 3/1999 | Burris | |
| 5,997,350 | A | 12/1999 | Burris et al. | |
| 6,089,913 | A | 7/2000 | Holliday | |
| 6,261,126 | B1 * | 7/2001 | Stirling | 439/583 |
| 6,817,897 | B2 | 11/2004 | Chee | |
| 6,848,939 | B2 | 2/2005 | Stirling | |
| 7,021,965 | B1 * | 4/2006 | Montena et al. | 439/578 |
| 7,029,326 | B2 | 4/2006 | Montena | |
| 7,044,785 | B2 | 5/2006 | Harwath et al. | |
| 7,156,695 | B2 | 1/2007 | Holliday | |
| 7,179,122 | B2 | 2/2007 | Holliday | |
| 7,192,308 | B2 | 3/2007 | Rodrigues et al. | |
| 7,255,598 | B2 * | 8/2007 | Montena et al. | 439/578 |
| 2006/0211304 | A1 | 9/2006 | Holland | |
| 2007/0042642 | A1 | 2/2007 | Montena et al. | |
| 2007/0093128 | A1 | 4/2007 | Thomas et al. | |
| 2009/0186505 | A1 * | 7/2009 | Mathews | 439/271 |

FOREIGN PATENT DOCUMENTS

JP 10316096 A1 5/2000

* cited by examiner

*Primary Examiner* — Chandrika Prasad
(74) *Attorney, Agent, or Firm* — Schmeiser, Olsen & Watts, LLP

(57) ABSTRACT

A coaxial cable connector for connecting a coaxial cable to an RF port, wherein the cable connector is comprised of a connector subassembly and a compression cap. The connector subassembly is of simple inexpensive construction and is comprised of a fastener, a tubular post, and a connector body. The connector subassembly may function a stand-alone crimpable cable connector. The compression cap may be placed over the end of a coaxial cable, and compressed onto the connector subassembly to secure a prepared end of the cable within the compressed and assembled connector.

11 Claims, 5 Drawing Sheets

COAXIAL CABLE CONNECTOR WITH A DEFORMABLE COMPRESSION CAP TO FORM A CONSTRICTION

BACKGROUND OF THE INVENTION

1. Field of the Invention

The present invention relates generally to coaxial cable end connectors of the type employed in the cable television industry. More particularly, the present invention relates to an inexpensive connector that can be securely fitted to coaxial cables of several different sizes.

2. Description of Related Art

A conventional coaxial cable typically is comprised of a centrally located inner electrical conductor surrounded by and spaced inwardly from an outer cylindrical electrical conductor. The inner and outer conductors are separated by a dielectric insulating sleeve, and the outer conductor is encased within a protective dielectric jacket. The outer conductor can comprise a sheath of fine braided metallic strands, a metallic foil, or multiple layer combinations of either or both.

In the transmission of cable television signals, a large low-loss high capacity coaxial cable is run between utility poles or buried underground, typically along a highway or other thoroughfare. Smaller "drop" cables are connected to this main cable and run to the customer sites, i.e. businesses, residences, schools, etc.

In order to connect a coaxial cable to a port of a device (such as a television, a video recording device, or a cable junction/receiving box within a residence) to receive a transmitted signal, a connector fitting must be installed on the end of the cable. Generally, coaxial cable connectors are provided in two configurations: crimp connectors and compression connectors.

Crimp connectors are generally the lowest cost connectors, and are often used within residences by homeowners to terminate coaxial cables and connect them to their entertainment devices. A typical crimp connector is comprised of three parts: a threaded fastener for securing the connector to an equipment port such as a radio frequency (RF) port, a thin-walled crimpable connector body, and a tubular post contained within the connector body. To terminate and connect the coaxial cable to the crimp connector, the end of the cable is prepared (as will be described subsequently herein), and inserted into the connector. The wall of the connector is then crimped with a crimping tool that has jaws which radially inwardly deform the connector body against the cable end, thereby binding it within the connector.

In contrast, a typical coaxial compression connector for connection to a coaxial cable typically includes four parts: a threaded fastener for securing the connector to the equipment port, a connector body, a tubular post contained within the connector body, and a compression or locking sleeve, which is secured to the connector body and the coaxial cable disposed therein by axial compression against the connector body.

By way of illustration, U.S. Pat. No. 4,902,246 of Samchisen, the disclosure of which is incorporated herein by reference, describes a "snap-n-seal" connector including a connector body, an annular compression sleeve, and optionally, a sealing nut. The connector body includes an annular collar member which peripherally engages the jacket of a coaxial cable, a post member coaxially disposed within the annular collar member to engage the dielectric insulation and the braided shield of the coaxial cable, and a rotatable nut member disposed in combination with the collar and post members. The compression sleeve is configured for snap fitting engagement between the jacket of the coaxial cable and the annular collar member to provide a moisture proof circular seal therebetween and to force the braided shield into mechanical and electrical engagement with the contact spring member an/or the post member. The compression sleeve includes a sealing member to provide a 360 degree moisture proof seal between the compression sleeve and the collar member. The sealing nut includes a sealing member and is threaded onto an interface connector to provide a moisture proof seal between the interface connector and the nut member.

Additionally, U. S. Pat. No. 5,470,257 to Szegda, which is assigned to the assignee of the present invention and incorporated herein by reference, discloses a compression type coaxial cable end connector (known commercially as a "CMP" connector) comprising a connector body having a tubular inner post extending from a front end to a rear end, and including an outer collar surrounding and fixed relative to the inner post at a location disposed rearwardly of the front post end. The outer collar cooperates with the inner post to define an annular chamber with a rear opening. A fastener at the front end of the inner post serves to attach the end connector to a system component. A tubular locking member protrudes axially into the annular chamber through its rear opening.

Compression-type cable connectors are significantly more expensive than crimp type connectors, and also require a more complex corresponding compression tool. Although compression connectors provide a connection with a higher quality signal and greater moisture resistance, they are generally not used by homeowners due the their higher cost. It would therefore be desirable to somehow provide a way to inexpensively transform a crimp connector into a compression connector that utilizes a standard compression tool.

Crimp type cable connectors presently require crimp tools that feature crimping nests for each cable size/construction within a given cable standard such as RG59 or RG6. This often presents problems for inexperienced installers (such as homeowners) in terms of consistent quality of termination.

For compression-type cable connectors, the problem of variation in cable size must also be addressed. In most prior art connectors comprised of a compression sleeve that is fitted to a connector body, the compression sleeve is provided in at least two, and possibly three different sizes to correspond to the three different cable diameters. This is because the compression ring or ferrule of the compression sleeve does not undergo a sufficient reduction in inner diameter during the compression of the sleeve into the connector body when installing the connector on the cable, such that the compression sleeve sufficiently seals and binds to the cable, regardless of its diameter and shield construction.

In addition to carrying two or three different sizes of compression sleeve, a cable technician typically carries a single compression tool. This is inconvenient for the technician, and the process has considerable opportunities for errors in the field that result in improper cable fitting installation and/or loss of compression sleeves and compression tools. For an inexperienced user such as a homeowner, who wants to use inexpensive cable connectors and have minimal tooling costs, this scenario is unworkable. What is needed is an inexpensive way to transform a crimp connector into a compression connector that utilizes a standard compression tool.

A coaxial cable connector is provided as described in U.S. Pat. No. 6,848,939 to Sterling, the disclosure of which is incorporated herein by reference. The coaxial cable connector of Sterling is comprised of an internal body and an external body or bushing (i.e. compression piece) which are assembled together, and which can be activated to clamp upon and seal to an inserted coaxial cable without disassembling the external body from the internal body. The bushing is made of a rigid material such as brass, but includes a deformable inner collar of a plastic such as Delring® that permits the connector to be attached and sealed to cables of varying thickness.

Another connector that functions in a similar manner is described in U.S. Pat. No. 5,879,191 of Burris, the disclosure of which is incorporated herein by reference. Burris describes a cable connector comprising a tubular post and fastening nut, along with a modified form of body member. The body member outer wall includes a series of annular ridges, and the end of the body member includes a beveled surface. The connector includes a collar assembly (i.e. compression piece) that incorporates a gripping ring. The collar assembly has a central passage for receiving the end of the coaxial cable. One end of the collar assembly has an internal bore of a diameter commensurate with the outer diameter of the body member; the internal bore also has annular ridges formed thereon which frictionally engage the ridges on the outer wall of the body member. A compression tool longitudinally compresses the collar assembly over the body member during installation, causing the beveled surface of the body member to cam the gripping ring inwardly toward the tubular post, securing the outer jacket and conductive braid of the coaxial cable therebetween.

Although the connectors of Sterling and Burris are compression connectors, they do not accomplish their results at a low cost. The Sterling and Burris connectors are both configured such that their respective fasteners, tubular posts, and connector bodies are designed to match with their respective compression pieces. Both connectors have the relatively high complexity and the high cost of typical compression cable connectors.

Thus there remains a need for a coaxial cable connector having the locking and sealing advantages of a compression type connector, at about the same low cost as a crimp-type connector. The connector should have a compression piece that can be installed with a simple compression tool.

SUMMARY OF THE INVENTION

The present invention meets this need by providing a coaxial cable connector for connecting a coaxial cable to an RF port, wherein the cable connector is comprised of a connector subassembly and a compression cap. The connector subassembly is of simple inexpensive construction, and may function a stand-alone crimpable cable connector. The compression cap may be placed over the end of a coaxial cable, and compressed onto the connector subassembly to secure a prepared end of the cable within the compressed and assembled connector. The compression cap may be made using a simple molding process and mold tooling, and is thus inexpensive. Accordingly, the combination of the compression cap and the connector subassembly provides a coaxial cable compression-type connector at low cost.

More particularly, the connector subassembly is comprised of a fastener comprising a forward end and a rearward end and including an axial bore therethrough having a shoulder proximate to the rearward end; a tubular post comprising a central bore, a flange engaged with the shoulder in the axial bore of the fastener, a bonding region, and a tubular extension extending rearwardly from the bonding region and terminating at an annular barb; and a connector body comprising a deformable wall having an axial bore therethrough. The axial bore has a forward region joined to the bonding region of the tubular post, and a rearward region surrounding the tubular extension of the tubular post to form a first annulus. The connector body is provided with a radially inwardly deformable wall so that the connector subassembly may optionally be used as a crimp-type connector, with the deformable wall being crimped onto the cable by a crimping tool.

The compression cap is comprised of an integral compression ferrule comprised of a forwardly extending length of ferrule wall bounded by an inner bore surface, a forward end, and an outer surface; a bottom region extending radially outwardly from a rearward end of the forwardly extending ferrule wall; and a sleeve wall extending forwardly from the bottom region, terminating at a forward end, thereby forming a second annulus between the sleeve wall and the ferrule wall. The compression cap is movable between a first position not engaged with the connector body to a second position engaged with the connector body, the compression cap being configured to receive a prepared coaxial cable. When the compression cap is advanced axially from the first position to the second position, the rearward region of the connector body is received in the second annulus and forms a constriction between the annular barb of the tubular post and the inner bore surface of the ferrule wall. In general, the compression cap serves as means for forming a constriction within the annulus with annular barb of the tubular post when the compression cap is advanced axially from the first position to the second position. The prepared end of the coaxial cable is thus bound within the constriction.

The ferrule wall of the integral compression ferrule may be tapered to a reduced thickness at its forward end. In such an instance, when the compression cap is advanced to the second position, the ferrule wall is deformed inwardly by contact with the rearward region of the connector body. Additionally, when the compression cap is compressed onto the connector body and in the second position, the rearward end of the connector body is preferably in contact with the bottom region of the compression cap. The ferrule wall of the compression cap is preferably elongated substantially such that the forward end of the ferrule wall terminates proximate to the forward end of the sleeve wall. The forward end of the ferrule wall may even extend to the point where it is coplanar with the forward end of the sleeve wall.

The deformable wall of the connector body may be comprised of a plurality of axially spaced ribs. Such ribs may serve to provide the wall with a greater degree of deformability, such that the wall may be more easily deformed and collapsed inwardly when radially inward forces are applied to the wall by a crimping tool. The ribs may have sharp edges, such that when the compression cap is compressed onto the connector body and placed in the second position, the sharp edge(s) of at least one of the axially spaced ribs may be engaged with the sleeve wall, which is a generally smooth, uniform surface. The tight fit of the sleeve wall around the ribs of the connector body cause the sharp edges to dig into the smooth surface of the sleeve wall. This better engages the connector body with the sleeve wall and makes it more difficult to separate the two pieces and pull the cable out of the connector. The sleeve wall may also deform radially inwardly between two adjacent axially spaced ribs to further engage the compression cap with the connector body and resist its removal therefrom.

In accordance with the invention, there is also provided a method for terminating an end of a coaxial cable within a coaxial cable connector. The coaxial cable is comprised a center conductor surrounded by an insulator, a conductive shield surrounding the insulator, and an insulative jacket surrounding the conductive shield. The method includes providing the coaxial cable connector comprised of a fastener, tubular post, connector body, and compression cap as recited herein. The end of the coaxial cable is inserted through the compression cap, and the end of the coaxial cable is prepared by stripping a first extent of insulator, conductive shield, and insulative jacket to expose a length of center conductor, stripping a second extent of insulative jacket to expose a length of conductive shield, and folding back the exposed length of conductive shield axially along the insulative jacket. The prepared end of the coaxial cable is inserted into the rearward region of the connector body, such that the central bore of the tubular post receives a portion of the center conductor and insulator, and the exposed length of conductive shield is disposed in the first annulus between the connector body and the tubular post. The compression cap is moved forwardly along the coaxial cable such that the rearward region of the connector body is received in the second annulus within the compression cap and forms a constriction between the annular barb of the tubular post and the inner bore surface of the ferrule wall, thereby binding the cable between the ferrule wall and the tubular extension of the tubular post.

The ferrule wall of the integral compression ferrule may be tapered to a reduced thickness at its forward end, and in such an instance, the method may further comprise contacting the ferrule wall with the rearward region of the connector body, thereby deforming the ferrule wall inwardly against the coaxial cable. The method may further include compressing the compression cap against the connector body until the rearward end of the connector body is in contact with the bottom region of the compression cap.

The foregoing and additional objects, advantages, and characterizing features of the present invention will become increasingly more apparent upon a reading of the following detailed description together with the included drawings.

BRIEF DESCRIPTION OF THE DRAWINGS

The present invention will be described by reference to the following drawings, in which like numerals refer to like elements, and in which.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DETAILED DESCRIPTION OF THE PREFERRED EMBODIMENTS

Figure 1:
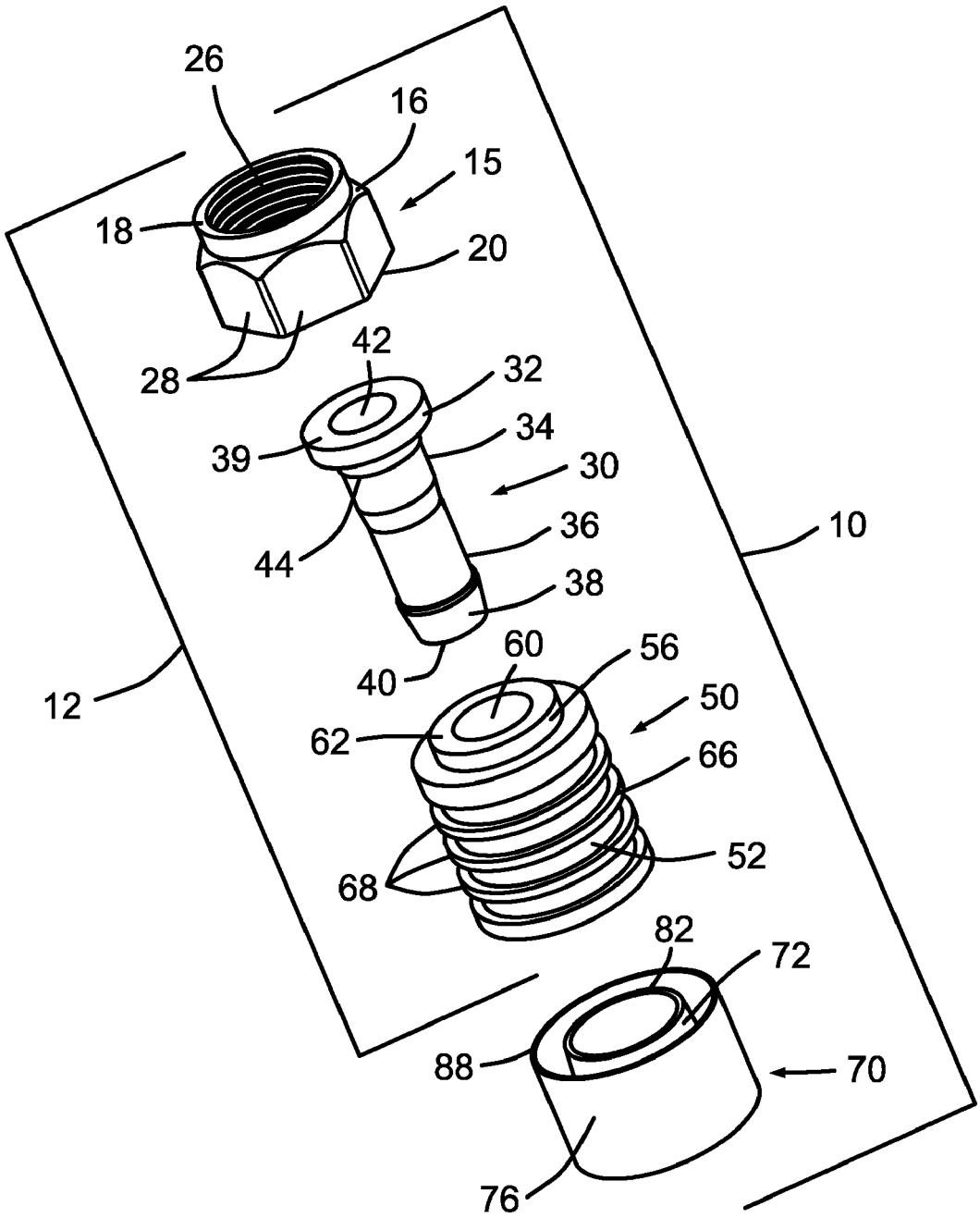
FIG. 1 is an exploded perspective view of a connector of the present invention.
Figure 2:
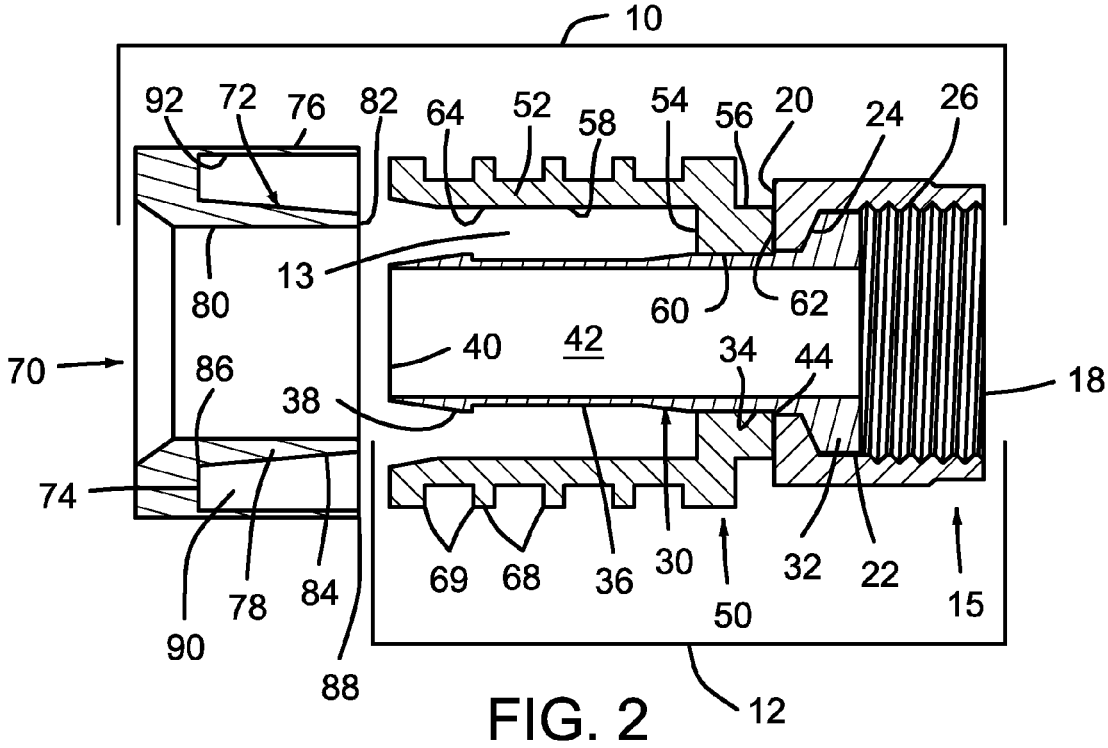
FIG. 2 is a cross-sectional view of the connector of FIG. 1 in a partially assembled state, with the compression cap in an unfitted position with respect to the connector body.
Figure 3:
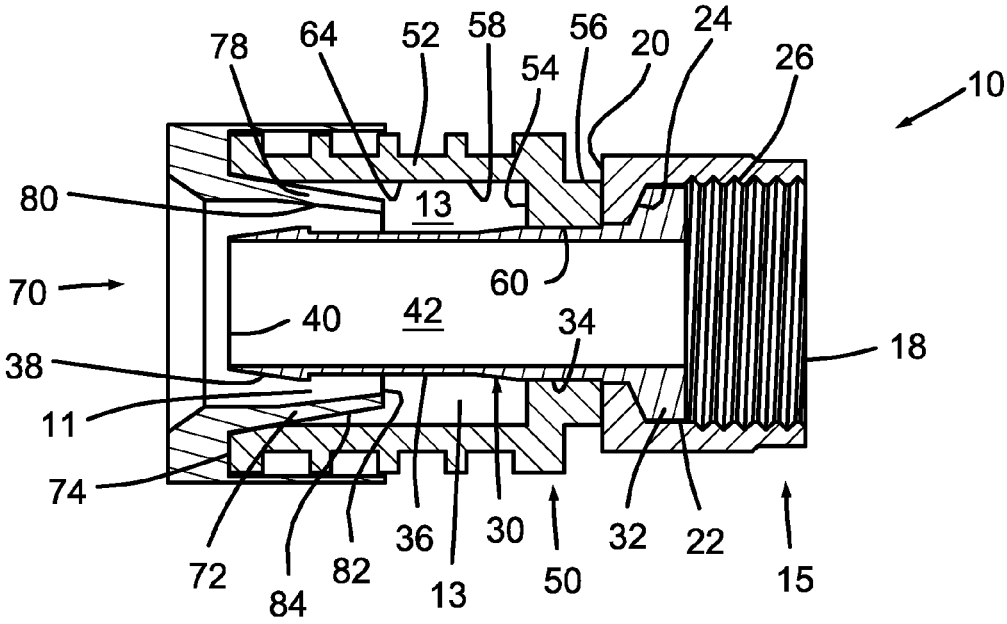
FIG. 3 is a cross-sectional view of the connector of FIG. 1 with the compression cap advanced to an engaged position with respect to the fastener.

Referring first to FIGS. 1-3, coaxial cable connector 10 is comprised of a connector subassembly 12 and a compression cap 70. The connector subassembly 12 is of simple inexpensive construction, and may function a stand-alone crimpable cable connector, wherein the prepared end of a coaxial cable is secured within the subassembly 12 by crimping. Alternatively, the compression cap 70 may be placed over the end of a coaxial cable, and compressed onto the connector subassembly 12 to secure a prepared end of the cable within the compressed and assembled connector 10.

The connector subassembly 12 is comprised of a fastener 15, a tubular post 30, and a connector body 50. The fastener 15 is comprised of a body 16 having forward end 18 and a rearward end 20. The body 16 includes an axial bore 22 passing therethrough and having a shoulder 24 proximate to the rearward end 20. The fastener 15 is preferably a nut-type fastener. A portion of the axial bore 22 of the fastener 15 proximate to the forward end 18 is comprised of threads 26 that are engageable with corresponding threads of a cable television component or other system component (not shown). To facilitate the threading and tightening of the connector 10 on a system component, the exterior surface of the fastener 20 may be provided with a plurality of flats 28 for engagement with a wrench, as is typical of nut-type fasteners.

The tubular post 30 is comprised of a flange 32, a bonding region 34, and a tubular extension 36 extending rearwardly from the bonding region 34. The tubular extension 36 preferably terminates at an annular barb 38 at the rearward end 40 of the tubular post 30. A central bore 42 passes longitudinally through the center of the tubular post 30. Flange 32 is engaged with the shoulder 24 in the axial bore 22 of the fastener 15, in order to retain the fastener 15 as part of the subassembly 12.

The connector body 50 includes a deformable wall 52, a shoulder 54, and a forward wall portion 56, with an axial bore 58 passing longitudinally through the deformable wall portion 52 and forward wall portion 56. The axial bore 58 of the connector body 50 has a forward region 60 joined to the bonding region 34 of the tubular post 30. The joining of the forward region 60 to the bonding region 34 is preferably accomplished by a press-fit, with a shoulder 44 of the tubular post abutted against the forward end 62 of the connector body. Alternatively, the forward region 60 may be joined to the bonding region 34 by applying a small amount of adhesive to the surfaces thereof prior to assembly. In any case, the joining of the forward region 60 to the bonding region 34 immobilizes the tubular post 30 within the connector body 50, making the assembled parts function as a single unitary part. The fastener 15 is rotatable with respect to the tubular post 30 and the connector body 50.

The axial bore 58 of the connector body 50 further includes a rearward region 64 surrounding the tubular extension 36 of the tubular post 30 to form a first annulus 13 within the connector subassembly 12. The first annulus 13 is configured to receive the prepared end of a coaxial cable as will be explained subsequently herein.

The connector body 50 is provided with a radially inwardly deformable (i.e. crimpable) wall 52. In that manner, the connector subassembly 12 may optionally be used as a crimp-type connector without the compression cap 70. The deformable wall 52 may crimped onto the end of a cable (not shown) by a crimping tool (not shown). Thus the connector subassembly 12 is essentially a simple, stand-alone crimp-type coaxial connector that can be manufactured at low cost. The deformable wall 52 of the connector body may be comprised of a plurality of axially spaced ribs 68. Such ribs 68 may serve to provide the wall 52 with a greater degree of deformability, such that the wall 52 may be more easily deformed and collapsed inwardly into a desired shape, such as a hexagonal shape, when radially inward forces are applied to the wall 52 by a crimping tool.

The compression cap 70 is comprised of an integral compression ferrule 72, a bottom region 74, and a sleeve wall 76. The integral compression ferrule 72 is comprised of a forwardly extending length of ferrule wall 78 bounded by an inner bore surface 80, a forward end 82, and an outer surface 84. The bottom region 74 extends radially outwardly from the rearward end 86 of the forwardly extending ferrule wall 78. The sleeve wall 76 extends forwardly from the bottom region 74 and terminates at a forward end 88, thereby forming a second annulus 90 between the sleeve wall 76 and the ferrule wall 78. The compression cap 70 is configured to receive a prepared coaxial cable within the inner bore surface 80 thereof.

The compression cap 70 is movable between a first position not engaged with the connector body 50 to a second position engaged with the connector body 50, in order to secure the prepared end of a coaxial cable within the connector 10. The installation of a coaxial cable within the connector 10 will now be described with reference in particular to FIGS. 4A-7. In this specification, the first position may be referred to as the unengaged or unfitted position, and the second position may be referred to as the engaged position or fitted position.

Figure 4A:
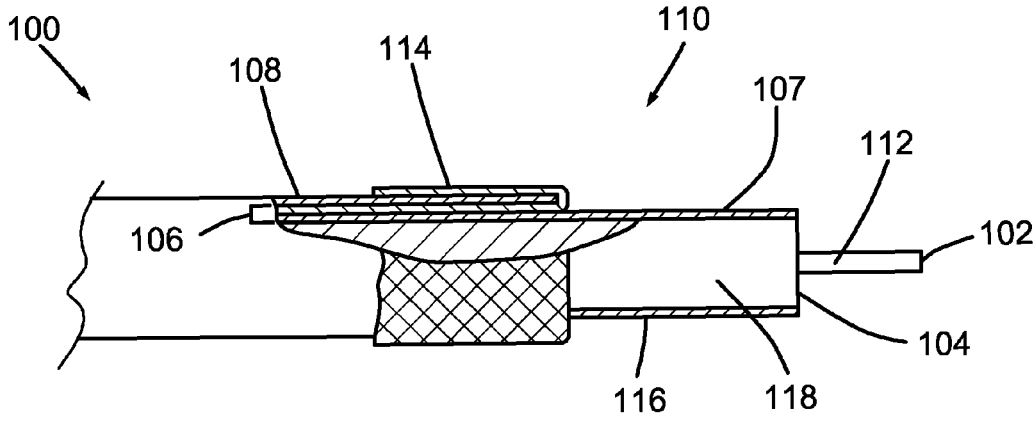
FIG. 4A is a side view of a prepared end of a first coaxial cable having a simple shield that includes a single layer of metal foil and a single layer of braided metal wire.

FIG. 4A is a side view of an end of a coaxial cable 100 that has been prepared for termination within the connector 10. The coaxial cable 100 is comprised of a central electrical conductor 102 formed of copper or other suitably conductive material. The center conductor 102 is encased in an insulator 104 formed of a suitably insulative material such as plastic, which in turn is surrounded by a conductive shield 106. A protective insulative jacket 108 encases the conductive shield 106. The conductive shield 106 is typically made from fine braided metallic strands, and may further include a metallic foil 107, or multiple layer combinations of either or both, such as e.g., Tri-Shield or Quad-Shield as described previously herein.

The prepared cable end 110 may be made by stripping a first extent of insulator 104, conductive shield 106, and insulative jacket 108 to expose a length 112 of center conductor 102, stripping a second extent of insulative jacket 108 to expose a length 114 of conductive shield 106, and folding back the exposed length 114 of conductive shield 106 axially along the insulative jacket 108. If the conductive shield 106 includes a metallic foil 107, a portion 116 of the foil 107 may extend from the folded-back length 114 of conductive shield 106 along the exposed length 118 of insulator 104.

Figure 4B:
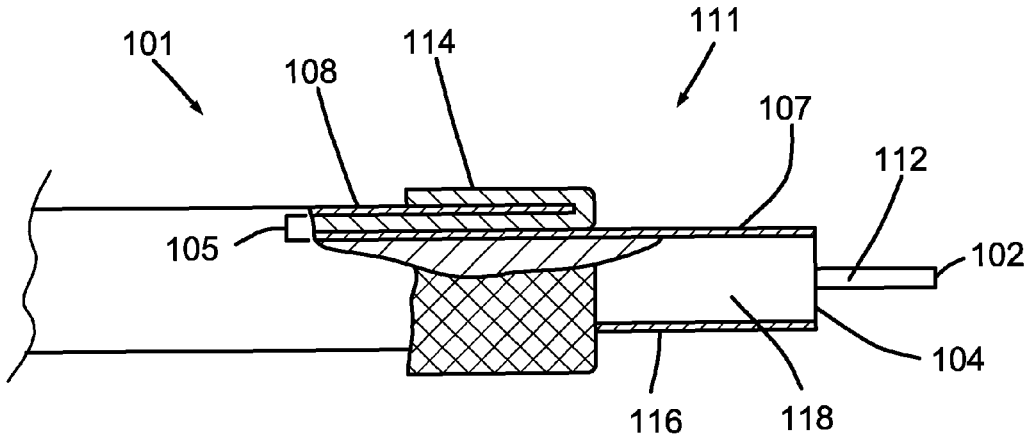
FIG. 4B is a side view of a prepared end of a second coaxial cable having a thicker and more effective shield that may include additional layers of metal foil and braided metal wire.

FIG. 4A is generally representative of a coaxial cable 100 with a simple "Single tape and braid" conductive shield. FIG. 4B is a side view of a prepared end of a second coaxial cable 101 having a thicker and more effective shield. Cable 101 is also comprised of a central electrical conductor 102 encased in an insulator 104, which is surrounded by a conductive shield 105 and a protective insulative jacket 108. The conductive shield 105 may be a "Quad-Shield" comprised of a first layer of metal foil, a first layer of braided metal wire, a second layer of metal foil, and a second layer of braided metal wire. For the sake of simplicity of illustration, the complete set of four layers of the Quad-Shield 105 are not shown in FIG. 4B. However, the greater thickness of the shield 105 of the cable 101 as compared to the thickness of the shield 106 of the cable 100, and the resulting greater diameter of the cable 101 compared to the cable 100 are approximately to scale for an exemplary RG6 coaxial cable. These two different-sized cables 100 and 101 are shown in the respective FIGS. 4A and 4B, and are also shown fully installed in the instant connector 10 in respective FIGS. 6 and 7, in order to show the capability of the instant connector 10 to accommodate coaxial cables of different sizes.

Figure 5:
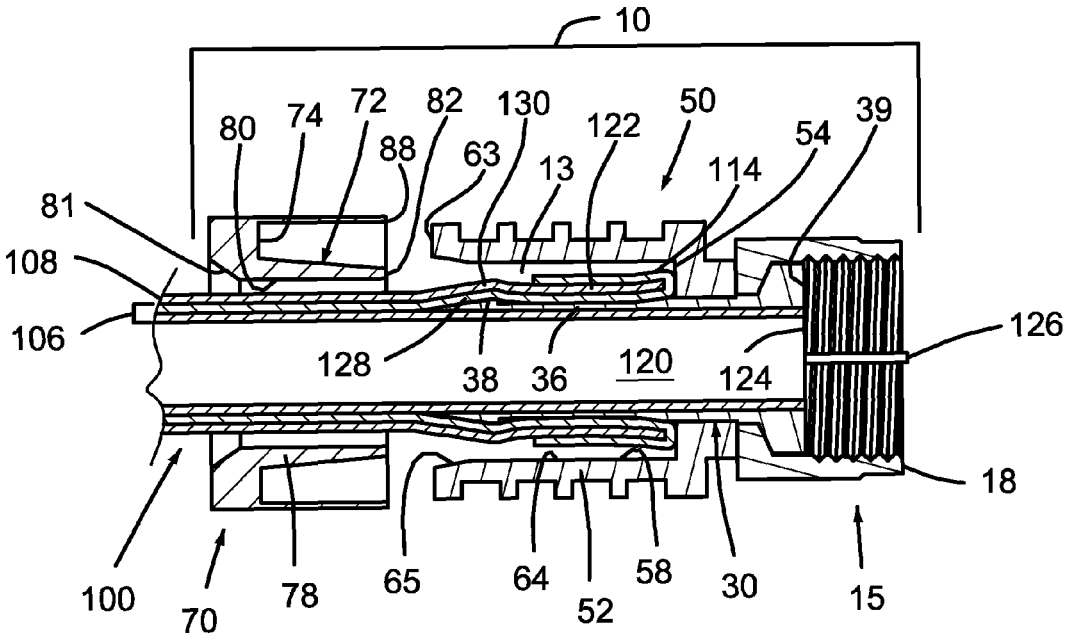
FIG. 5 is a is a cross-sectional view of the connector of FIGS. 1-3 with the compression cap in the unfitted position with respect to the connector body, and the prepared end of the coaxial cable of FIG. 4A disposed within the connector body.

FIG. 5 is a is a cross-sectional view of the connector of FIGS. 1-3 with the compression cap in the unfitted position with respect to the connector body, and the prepared end of the coaxial cable of FIG. 4A disposed within the connector body. To terminate the coaxial cable 100 within the coaxial cable connector 10, the prepared end 110 of the coaxial cable 100 is inserted into the connector 10 through the inner bore 80 of the compression cap 70 and into the rearward end 63 of the connector body 50. To facilitate the insertion of the prepared cable end 110 into the compression cap 70 and the rearward end 63 of the connector body 50, the inner bore 80 of the compression cap 70 may include a bevel 81, and the at the rearward end 63 of the connector body 50 may include a bevel 65. During the insertion of the prepared end 110 into the connector 10, the compression cap 70 may be in contact with the connector body 50, so long as the contact is not sufficient to deform the integral compression ferrule 72 inwardly. Alternatively, the compression cap 70 may be separate from the connector body 50 as shown in FIG. 5, such that the prepared end 110 is first inserted through the inner bore 80 of the compression cap 70 and then into the connector body 50. The compression cap 70 may then be axially advanced along the cable 100 to make contact with the connector body 50.

In either case, when the prepared cable end 110 is inserted into the connector body 50, the central bore 42 (FIG. 2) of the tubular post 30 receives a portion 120 of the center conductor 102 and insulator 104. The tubular extension 36 of the tubular post 30 penetrates between the insulator 104 and the conductive shield 106, such that the folded back length 114 of conductive shield and the end region 122 of insulative jacket 108 are contained within the first annulus 13 formed between the rearward region 64 of the axial bore 58 of the connector body 50 and the tubular extension 36 of the tubular post 30.

Upon completion of the insertion of the prepared cable end 110 into the connector body 50, the forward most exposed length 114 of conductive shield 106 is proximate to shoulder 54 of the connector body 50. More preferably, cable end 110 is prepared such that when it is fully inserted into the connector body 50, the forward most exposed length 114 of conductive shield 106 is abutted against shoulder 54 of the connector body 50; and the forward most surface 124 of the exposed length 118 of insulator 104 is approximately coplanar with the forward end 39 of the tubular post 30; and the forward most tip 126 of the exposed length 112 of center conductor 102 is approximately coplanar with the forward end 18 of the fastener 15.

Figure 6:
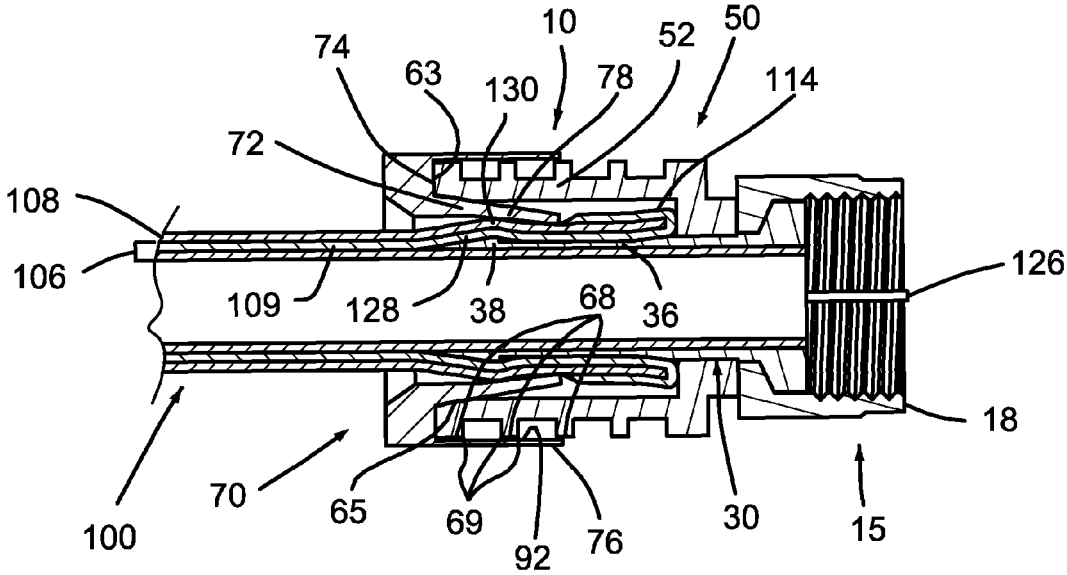
FIG. 6 is a cross-sectional view of the connector of FIG. 5 with the compression cap having been moved to the fitted position with respect to the connector body, and the prepared end of the coaxial cable of FIG. 4A fully installed within the connector.

Referring now to FIG. 6, to complete the termination of the coaxial cable 100 within the coaxial cable connector 10, the compression cap 70 is moved forwardly along and into the connector body 50 such that the rearward region 64 of the connector body 50 is received in the second annulus 90 between the sleeve wall 76 and the ferrule wall 78 of the compression cap 70. The movement of the compression cap 70 may be performed by hand (i.e. the installer's fingers), or preferably by the use of a suitably configured plier-like tool (not shown).

The tubular post 30 and the compression cap 70 are configured to form a constriction 11 (FIG. 3) between them when the compression cap 70 is moved to the forward position of FIG. 6 during the cable termination process. The constriction 11 serves to firmly hold the coaxial cable 100 installed within the connector 10. Referring first to FIGS. 2 and 5, the tubular extension 36 of the tubular post 30 is comprised of an annular barb 38. When the prepared cable end 110 is inserted into the connector body 50, the barb 38 deforms a portion 128 of the conductive shield layer 109 and a portion 130 of the insulative jacket 108 radially outwardly. However, the annulus 13 between the rearward region 64 of the connector body 50 and the tubular extension 36 of the tubular post 30 is sufficiently large so that the portion 128 of the shield layer 109 and the portion 130 of the jacket 108 are not constricted between them when the compression cap 70 is in the unengaged position.

Referring now to FIG. 3, when the compression cap 70 is advanced to the engaged position, the annular barb 38 of the tubular post 30 and the integral ferrule 72 of the compression cap 70 coact to form a constriction 11 between them. Referring also to FIG. 6, it can be seen that the portion 128 of the shield layer 109 and the portion 130 of the jacket 108 have been deformed within constriction 11, and that the annular barb 38 has dug into the shield layer 109. Thus the cable 100 is bound within the constriction 11 and held securely within the connector 10. The compression cap 70 provides a means for forming a constriction 11 within the annulus 13 with the annular barb 38 of the tubular post 30 when the compression cap 70 is advanced axially from the first position of FIG. 5 to the second position of FIG. 6.

In one embodiment depicted in FIGS. 3 and 6, the ferrule wall 76 of the integral compression ferrule 72 may be tapered to a reduced thickness at its forward end 82. In such an instance, when the compression cap 70 is advanced to the second position, the ferrule wall 76 is deformed inwardly by contact with the rearward region 64 of the connector body 50. The rearward region 64 may include a bevel 65, which provides more evenly distributed radially inward force on the ferrule wall 76 as it is advanced from the first position to the second position.

Additionally, when the compression cap 70 is compressed onto the connector body 50 and in the second position, the rearward end 63 of the connector body 50 is preferably in contact with the bottom region 74 of the compression cap 70. This provides a positive stop when the compression cap 70 is firmly compressed onto the connector body by a compression tool. Additionally, the ferrule wall 78 of the compression cap 70 is preferably elongated substantially such that the forward end 82 of the ferrule wall 78 terminates proximate to the forward end 88 of the sleeve wall 76. The forward end 82 of the ferrule wall 78 may even extend to the point where it is coplanar with the forward end 88 of the sleeve wall 76. By providing a ferrule wall 78 elongated to that extent, the ferrule wall is better able to form the constriction with the annular barb 38 of the tubular post 30, and, if necessary, to deform inwardly when the compression cap 70 is moved to the engaged position.

The fastener 15, tubular post 30, and connector body 50 are preferably made of a rigid material such as brass or steel. The tubular post 50 should be formed from a conductive material, such as brass or steel, in order to maintain the continuity of the electromagnetic shield provided by the outer conductor of the coaxial cable. The compression cap 70 is preferably made of a low-cost material that can be easily and inexpensively formed with precise dimensional tolerances. The material is also preferably a deformable material, so that the integral ferrule may deform somewhat when the connector 10 is fitted to a coaxial cable. Moldable plastic materials are preferred for making the compression cap 70. One preferred plastic material is DELRIN®, an acetal polyoxymethylene resin manufactured and sold by the E.I. du Pont de Nemours and Company of Wilmington, Del. Other suitable plastic materials include but are not limited to acrylonitrile butadiene styrene (ABS), polyetheretherketone (PEEK), and polyimides.

Referring again to FIG. 6, the axially spaced ribs 68 of the deformable wall 52 of the connector body may serve to better retain the compression cap in its engaged position, in addition to providing enhanced collapsibility as described previously. The ribs 68 may be provided with sharp edges 69, such that when the compression cap 70 is compressed onto the connector body 50 and placed in the engaged position, the sharp edge(s) 69 of at least one of the axially spaced ribs 68 may be engaged with the sleeve wall 76. The inside surface 92 of the sleeve wall 76 is a generally smooth, uniform surface. The tight fit of the sleeve wall 76 around the ribs 68 of the connector body 50 causes the sharp edges 69 to dig into the smooth inside surface 92 of the sleeve wall 76, thereby better engaging the connector body 50 with the sleeve wall 76 and making it more difficult to separate the two pieces and pull the cable 100 out of the connector 10. By making the compression cap 70 from a deformable material such as a plastic, the sleeve wall 76 may also deform radially inwardly between two adjacent axially spaced ribs 68 to further engage the compression cap 70 with the connector body 50 and resist its removal therefrom.

Figure 7:
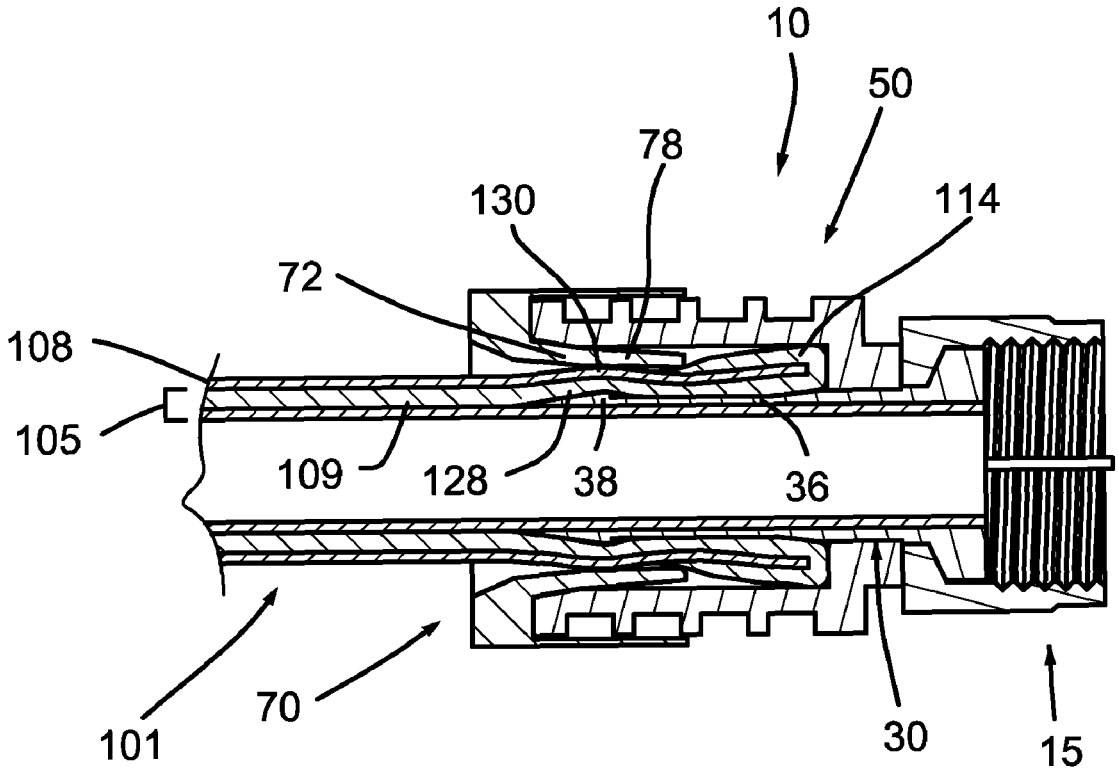
FIG. 7 is a cross-sectional view of the connector of FIGS. 1-3 with the compression cap in the fitted position with respect to the connector body, and the prepared end of the coaxial cable of FIG. 4B fully installed within the connector.

FIG. 7 is a cross-sectional view of the connector 10 of FIGS. 1-3 with the compression cap 70 in the fitted position with respect to the connector body 50, and the prepared end 110 of the coaxial cable 101 of FIG. 4B fully installed within the connector 10. FIG. 7 is provided to illustrate the manner in which the connector 10 can be fitted to a coaxial cable 101 of a larger diameter than the coaxial cable 100 of FIG. 4A. For example, coaxial cable 100 could be an RG6 Single tape and braid cable, and coaxial cable 101 could be an RG6 Quad-Shield cable having a thicker shielding jacket 105 as shown in FIG. 4B and provided in Table 1.

Connector 10 is fitted to cable 101 by following substantially the same procedure as described previously for cable 100. Because cable 101 is of a larger diameter than cable 100, and the prepared end 111 with its rolled-back shield 114 is of a larger diameter than the prepared end 110 of cable 100, it may be preferable to insert the end of cable 101 through the compression cap 70 prior to making its prepared end 111. The installation of connector 10 on cable 101 would then proceed as described previously for cable 100.

It can be seen in FIG. 7 that when the compression cap 70 is moved into its engaged position, the constriction 11 (FIG. 3) is sufficiently narrow so as to bind the portion 128 of the conductive shield layer 109 and the portion 130 of the insulative jacket 108 between the rearward region 64 of the connector body 50 and the tubular extension 36 of the tubular post 30. Thus the cable 101 is bound and retained in the connector 10 in the same manner as for the cable 100 in FIG. 6. The greater diameter of cable 101 due to its thicker shielding 105 is accommodated within the connector 10. Additionally, if the compression cap 70 is provided in a deformable material such as a plastic, the integral ferrule 72 may also be deformed radially inwardly to a lesser extent when it is fitted to the larger diameter cable 101.

It is, therefore, apparent that there has been provided, in accordance with the present invention, an inexpensive connector that can be securely fitted to coaxial cables of several different sizes, and a method for installing the connector on a coaxial cable. While this invention has been described in conjunction with preferred embodiments thereof, it is evident that many alternatives, modifications, and variations will be apparent to those skilled in the art. Accordingly, the present invention is intended to embrace all such alternatives, modifications and variations that fall within the broad scope of the appended claims.

What is claimed is:

1. A coaxial cable connector for connecting a coaxial cable to an RF port, the coaxial cable connector comprised of:

a fastener comprising a forward end and a rearward end and including an axial bore therethrough having a shoulder proximate to the rearward end;

a tubular post comprising a central bore, a flange engaged with the shoulder in the axial bore of the fastener, a bonding region, and a tubular extension extending rearwardly from the bonding region and terminating at an annular barb;

a connector body comprising a deformable wall having an axial bore therethrough, the axial bore having a forward region joined to the bonding region of the tubular post, and a rearward region surrounding the tubular extension of the tubular post to form a first annulus; and a compression cap movable between a first position not engaged with the connector body to a second position engaged with the connector body, the compression cap configured to receive a prepared coaxial cable, and comprising:

an integral compression ferrule comprised of a forwardly extending length of ferrule wall bounded by an inner bore surface, a forward end, and an outer surface;

a bottom region extending radially outwardly from a rearward end of the forwardly extending ferrule wall; and a sleeve wall extending forwardly from the bottom region, terminating at a forward end, and forming a second annulus between the sleeve wall and the ferrule wall;

wherein when the compression cap is advanced axially from the first position to the second position, the rearward region of the connector body is received in the second annulus and forms a constriction between the annular barb of the tubular post and the inner bore surface of the ferrule wall.

2. The connector of claim 1, wherein the ferrule wall of the integral compression ferrule is tapered to a reduced thickness at its forward end, and wherein when the compression cap is advanced to the second position, the ferrule wall is deformed inwardly by contact with the rearward region of the connector body.

3. The connector of claim 1, wherein the rearward region of the connector body terminates at a rearward end, and wherein when the compression cap is in the second position, the rearward end of the connector body is in contact with the bottom region of the compression cap.

4. The connector of claim 1, wherein the forward end of the ferrule wall terminates proximate to the forward end of the sleeve wall.

5. The connector of claim 4, wherein the forward end of the ferrule wall is substantially coplanar with the forward end of the sleeve wall.

6. The connector of claim 1, wherein the deformable wall of the connector body is comprised of a plurality of axially spaced ribs, and the sleeve wall of the compression cap is comprised of a smooth inner surface, and wherein at least one of the axially spaced ribs is engaged with the sleeve wall.

7. The connector of claim 6, wherein a portion of the sleeve wall deforms radially inwardly between two adjacent axially spaced ribs.

8. A method for terminating an end of a coaxial cable within a coaxial cable connector, the coaxial cable comprising a center conductor surrounded by an insulator, a conductive shield surrounding the insulator, and an insulative jacket surrounding the conductive shield, the method comprising:

providing the coaxial cable connector comprised of a fastener comprising a forward end and a rearward end and including an axial bore therethrough having a shoulder proximate to the rearward end; a tubular post comprising a central bore, a flange engaged with the shoulder in the axial bore of the fastener, a bonding region, and a tubular extension extending rearwardly from the bonding region and terminating at an annular barb; a connector body comprising a deformable wall having an axial bore therethrough, the axial bore having a forward region joined to the bonding region of the tubular post and a rearward region surrounding the tubular extension of the tubular post to form a first annulus; and a compression cap movable between a first position not engaged with the connector body to a second position engaged with the connector body, the compression cap configured to receive a prepared coaxial cable, and comprising an integral compression ferrule comprised of a forwardly extending length of ferrule wall bounded by an inner bore surface, a forward end, and an outer surface, a bottom region extending radially outwardly from a rearward end of the forwardly extending ferrule wall, and a sleeve wall extending forwardly from the bottom region and forming a second annulus between the sleeve wall and the ferrule wall;

inserting the end of the coaxial cable through the compression cap;

making a prepared end of the coaxial cable by stripping a first extent of insulator, conductive shield, and insulative jacket to expose a length of center conductor, stripping a second extent of insulative jacket to expose a length of conductive shield, and folding back the exposed length of conductive shield axially along the insulative jacket;

inserting the prepared end of the coaxial cable into the rearward region of the connector body, such that the central bore of the tubular post receives a portion of the center conductor and insulator, and the exposed length of conductive shield is disposed in the first annulus; and moving the compression cap forwardly along the coaxial cable such that the rearward region of the connector body is received in the second annulus and forms a constriction between the annular barb of the tubular post and the inner bore surface of the ferrule wall, binding the cable between the ferrule wall and the tubular extension of the tubular post.

9. The method of claim 8, wherein the ferrule wall of the integral compression ferrule is tapered to a reduced thickness at its forward end, and wherein the method further comprises contacting the ferrule wall with the rearward region of the connector body, thereby deforming the ferrule wall inwardly against the coaxial cable.

10. The method of claim 8, wherein the rearward region of the connector body terminates at a rearward end, and the method further comprises compressing the compression cap against the connector body until the rearward end of the connector body is in contact with the bottom region of the compression cap.

11. A coaxial cable connector for connecting a coaxial cable to an RF port, the coaxial cable connector comprising:

a fastener comprising a forward end and a rearward end and including an axial bore therethrough having a shoulder proximate to the rearward end;

a tubular post comprising a central bore, a flange engaged with the shoulder in the axial bore of the fastener, a bonding region, and a tubular extension extending rearwardly from the bonding region and terminating at an annular barb;

a connector body comprising a deformable wall having an axial bore therethrough, the axial bore having a forward region joined to the bonding region of the tubular post, and a rearward region surrounding the tubular extension of the tubular post to form an annulus; and a compression cap movable between a first position not engaged with the connector body to a second position engaged with the connector body, the compression cap configured to receive a prepared coaxial cable, and comprising means for forming a constriction by deformation of the compression cap within the annulus when the compression cap is advanced axially from the first position to the second position.

* * * * *